US005979208A

United States Patent [19]

Hartley

[11] Patent Number: 5,979,208

[45] Date of Patent: Nov. 9, 1999

[54] INSIDE PERIMETER HEMMER

[75] Inventor: William R. Hartley, Macomb, Mich.

[73] Assignee: UNOVA IP Corp.

[21] Appl. No.: 09/076,378

[22] Filed: May 12, 1998

[51] Int. Cl.[6] ..... B21D 39/02; B21D 5/04

[52] U.S. Cl. ..... 72/306; 72/323; 72/386; 29/243.58

[58] Field of Search ..... 72/322, 323, 306, 72/386; 29/243.58, 243.57, 243.518, 243.517

[56] References Cited

U.S. PATENT DOCUMENTS

| | | | |
|---|---|---|---|
| 3,143,095 | 8/1964 | Tribe | 72/322 |
| 3,598,073 | 8/1971 | Denis | 29/243.5 |
| 5,740,691 | 4/1998 | Kovarovic | 72/323 |

FOREIGN PATENT DOCUMENTS

| | | | |
|---|---|---|---|
| 68133 | 5/1980 | Japan | 29/243.517 |

*Primary Examiner*—Daniel C. Crane

*Attorney, Agent, or Firm*—Barnes, Kisselle, Raisch, Choate, Whittemore & Hulbert, P.C.

[57] ABSTRACT

An apparatus constructed to be received within an interior opening of a sheet metal panels to form a pre-hem and a complete hem about the periphery of the opening with a plurality of generally radially outwardly movable hemming plates or steels which are driven by an actuator to move from a retracted position within the opening to an extended position overlying a portion of the periphery of the opening to pre-hem a flange about the periphery of the opening. With the hem steels in their extended position, a second actuator displaces the steels towards the sheet metal panels to complete the folding or final hemming of the flange about the periphery of the opening. After forming the hem flange, the second actuator is reversed to move the hem steels away from the sheet metal panels and then the first actuator is reversed to move the hemming steels to their retracted position within and spaced from the periphery of the opening of the hemmed sheet metal panels so that the hemmed panels can be removed from the apparatus.

28 Claims, 6 Drawing Sheets

INSIDE PERIMETER HEMMER

FIELD OF THE INVENTION

This invention relates generally to hemming of sheet metal and more particularly to an apparatus for forming a hem about the perimeter of an interior opening in a panel.

BACKGROUND OF THE INVENTION

It is well known to construct motor vehicle body doors, hoods, fenders, tailgates, and trunk and deck lids by stamping an outer sheet metal panel and separately stamping an inner sheet metal reinforcing panel with an outer periphery generally matching that of the outer panel, and then joining the two panels together by hemming the periphery of the outer panel over an adjacent edge of the inner panel to thereby secure the panels together. The inner and outer panels are individually stamped to their desired size and shape, with the outer panel being slightly larger than the inner panel to provide a border flange portion along the edge of the outer panel having an upstanding lip which can be folded over the peripheral edge of the inner panel to define the hem flange which connects the two panels.

Of particular difficulty is the hemming of an inside perimeter such as about the periphery of a window of a vehicle door. Previously, the hemming of a window opening was performed in two or more forming operations in at least two separate forming stations. The first station hemmed a portion of the window perimeter and the second station was necessary to hem the voids or areas not hemmed by the first station such as at the corners of the window and also at the location of any gaps between the hemming steels of the first station apparatus. This not only requires the initial cost of two different hemming machines, but also increases the time to completely hem an inside perimeter such as for a window opening and increases the number of work stations the door or other sheet metal component must be transferred to thereby increasing the likelihood of damaging the door during its manufacture and the cost of tooling for and making the door.

SUMMARY OF THE INVENTION

An apparatus constructed to form a substantially complete hem about at least a portion of the perimeter of an interior opening of a sheet metal panel having at least two generally radially outwardly movable hemming plates or steels which are driven by an actuator to move from a retracted position within the opening to an extended position overlying a portion of the periphery of the opening to pre-hem the flange or at least partially form the hem flange about the periphery of the opening. With the hem steels in their extended position, a second actuator displaces the steels towards the sheet metal panel to finally hem or complete the folding or hemming of the flange about the periphery of the opening. After forming the hem flange, the second actuator is reversed to move the hem steels away from the sheet metal part and then the first actuator is reversed to radially inwardly move the hemming steels to their retracted position within and spaced from the periphery of the opening of the sheet metal panel so that the panel can be removed from the apparatus.

In one form, the first actuator comprises an actuator plate having a follower received in a cam track of each hemming steel. Rotation of the actuator plate moves each follower within its associated cam track and thereby causes movement of the hemming steels as the followers move within the cam tracks to actuate the hemming steels. In a second embodiment, the actuator is a crank operably coupled to a plurality of steels each received between a pair of adjacent hemming steels. Rotation of the crank in a first direction drives the steels coupled therewith generally radially outwardly causing the adjacent hemming steels to be moved generally radially outwardly over the portion of the perimeter of the opening to pre-hem the panel. In both embodiments, the hemming steels can be maintained in their extended position and moved towards the panel by the second actuator to final hem or complete the hemmed flange. Also, in each embodiment, there are substantially no gaps between adjacent hemming steels or wedges and the hemming steels or wedges when extended substantially completely overlie all of the portion of the perimeter of the opening where it is desired to form the hemmed flange.

Objects, features and advantages of this invention include providing an apparatus to form a substantially continuous hem about at least a portion of the perimeter of an interior opening in a panel which is constructed to be received within the opening of the panel, forms a complete hem flange around substantially the entire perimeter of an opening to be hemmed of the panel at one forming station, eliminates gaps between hemming steels, is compact, rugged, durable, of relatively simple design and economical manufacture and assembly, and has a long useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
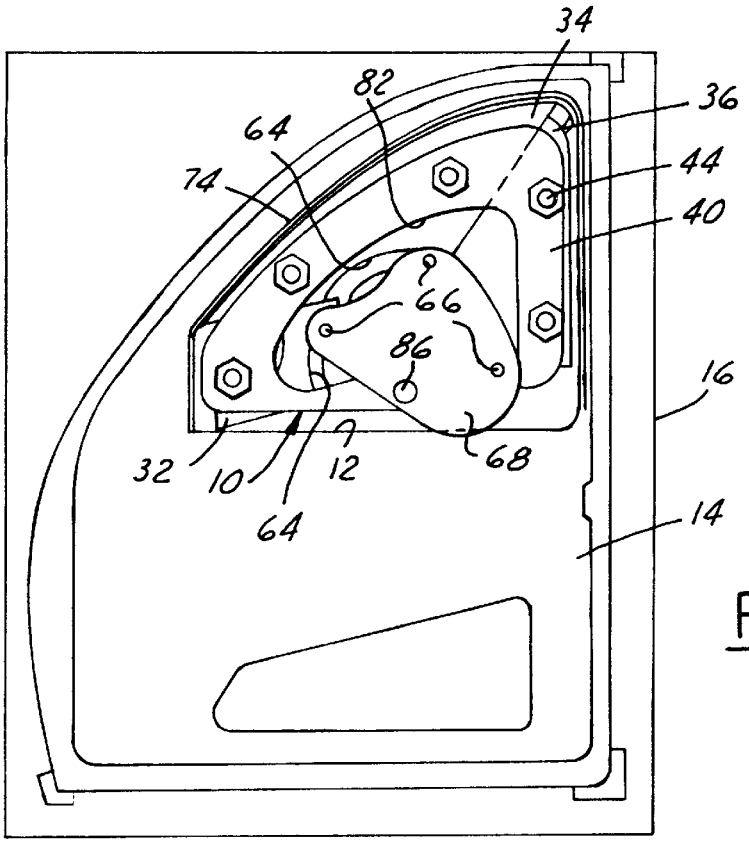
FIG. 1 is a top view of a hemming apparatus embodying this invention for hemming a window opening of a vehicle door received in a fixture of a work station.
Figure 2:
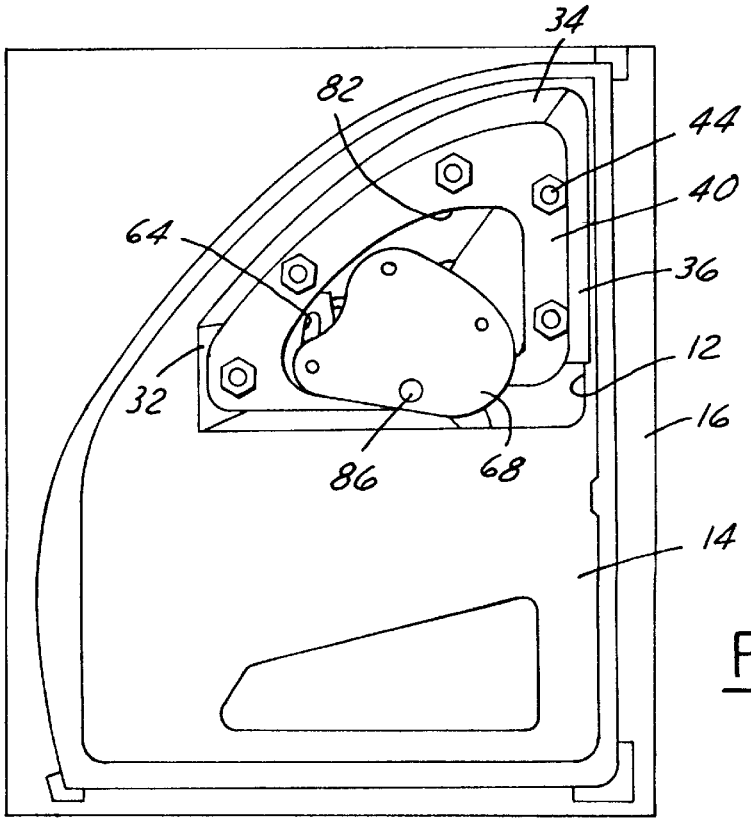
FIG. 2 is a top view of the hemming apparatus of FIG. 1 shown in its extended position to pre-hem a substantial portion of the window opening.

Referring in more detail to the drawings, FIGS. 1 and 2 illustrate an apparatus 10 constructed to form a substantially complete hem about at least a portion of the perimeter of an interior opening 12 of sheet metal panels of a vehicle door 14 carried on a fixture 16. The vehicle door 14 has an outer sheet metal panel 18 and an inner sheet metal reinforcing panel 20 (FIGS. 9 and 10) with generally complimentary outer peripheries and with the window opening 12 through them. To provide a finished edge and secure the panels 18, 20 together, a flange along the outer peripheral edge of the outer panel 18 is folded over or hemmed over the outer peripheral edge of the inner panel 20. Further, a flange of the outer panel is hemmed over the edge of the inner panel along at least a portion of the perimeter of the inner panel of the window opening 12.

As shown in FIGS. 3–11, the apparatus 10 has a frame 22 with a base 24 and a pair of upstanding supports 26 extending therefrom, a carrier plate 28 attached to the supports 26, a bearing plate 30, at least two and preferably three hemming plates or steels 32, 34, 36 slidably carried by the bearing plate 30, and a lower pull plate 38 interconnected to an upper pull plate 40 preferably overlying at least a portion of each of the steels 32–36. A first actuator displaces the steels 32–36 generally radially outwardly to initially bend or pre-hem a flange along a portion of the peripheral edge of the window opening 12 of the outer panel 18. When the outer edge of the steels 32–36 overlie the edge of the outer panel 18 to be hemmed, a second actuator displaces the steels 32–36 towards the panels (downward) to complete the hem. Thereafter, the second actuator is reversed to move the steels 32–36 away from the hemmed edge and the first actuator is reversed to slidably displace or retract the steels 32–36 generally radially inwardly to be received again within the window opening 12 and spaced from the perimeter of the opening 12 such that the hemmed door 14 can be removed from the fixture 16 and another set of door panels 18, 20 placed thereon.

Figure 6:
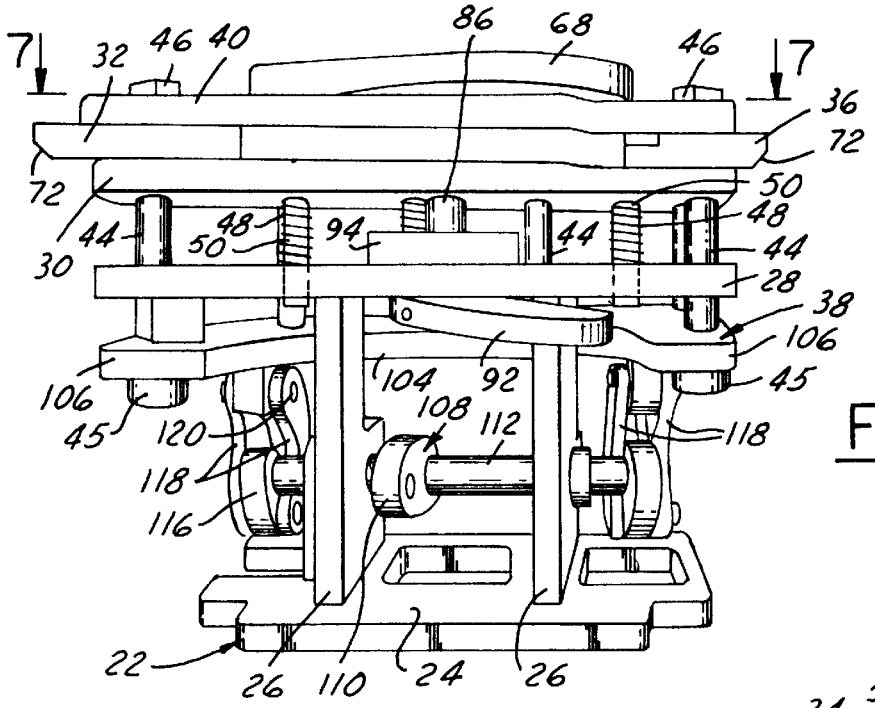
FIG. 6 is a perspective rear view of the hemming apparatus.
Figure 9:
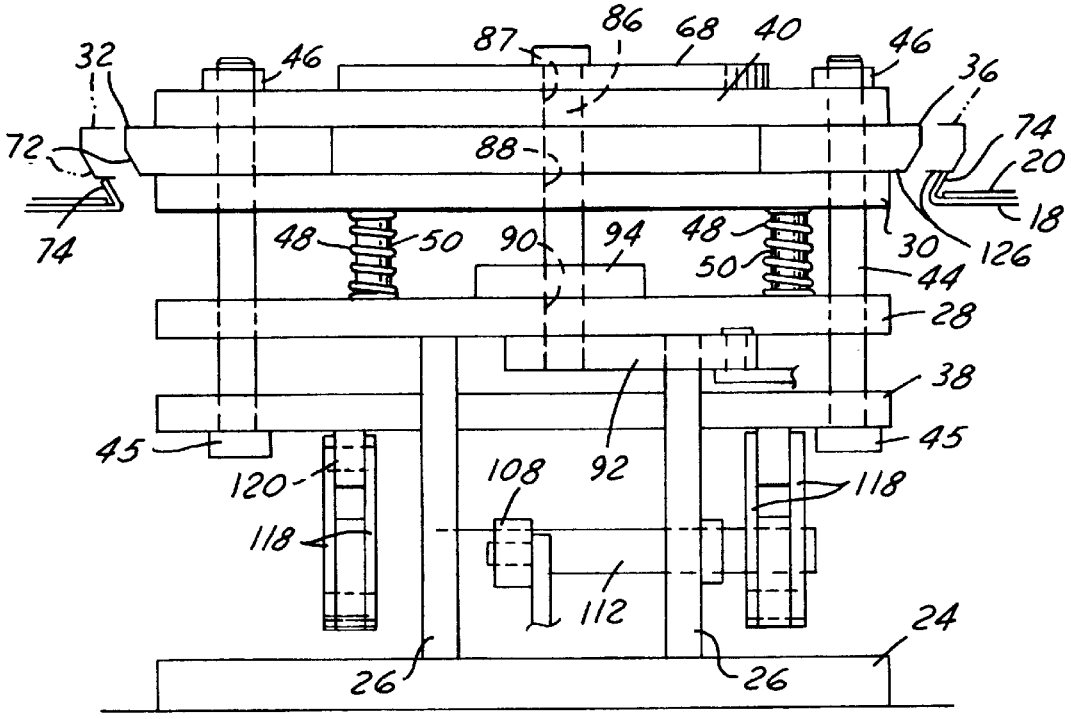
FIG. 9 is a rear view of the hemming apparatus received within the window opening of the sheet metal door panels with the hemming steels forming a pre-hem.
Figure 10:
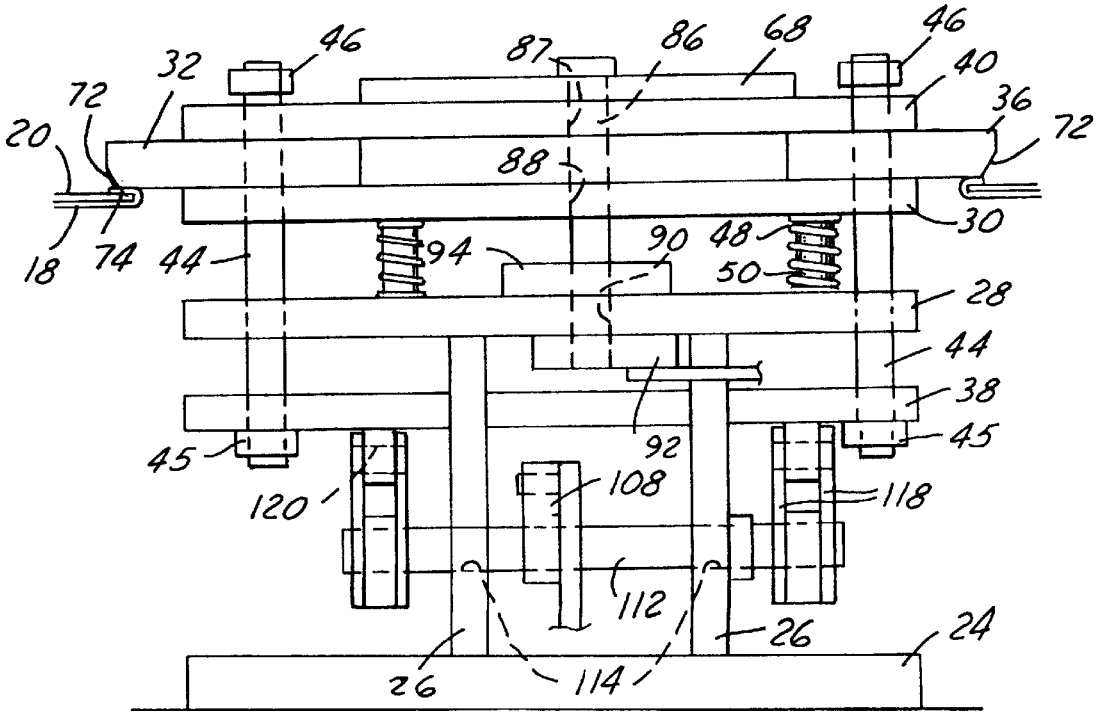
FIG. 10 is a rear view of the hemming apparatus per FIG. 9 illustrating the hemming steels in their extended and lowered position overlying the periphery of the opening in the panel and completing the final hem.

As best shown in FIGS. 6, 9 and 10, the supports 26 are fixed to the base 24 at one end and the carrier plate 28 at their other end to provide the fixed or stationary frame of the apparatus. Elongate tie rods 44 with threaded ends and nuts 46 interconnect and attach the lower pull plate 38 and upper pull plate 40 and extend through the carrier plate 28, the bearing plate 30, and may extend through clearance slots through the steels 32–36. The tie rod 44 preferably has an enlarged head 45 at one end and is threaded and has a nut 46 received on its other end to permit quick and easy adjustment of its effective length to balance or equalize the axial location or height of the steels 32–36 relative to the carrier plate 28 and the force applied to the upper plate 40 and steels through the lower pull plate 38 and tie rods. The bearing plate 30 is yieldably urged away from the carrier plate 28 by springs 48 disposed between them and preferably received over a retainer rod 50 fixed to the bearing plate 30 extending through clearance holes in the carrier plate 28. Alternatively, the springs 48 may be received over the tie rods 44. The springs 48 yieldably bias the bearing plate 30 into a first or raised position spaced from the carrier plate 28.

The bearing plate 30 preferably has a generally flat, planar bearing surface 52 on which the steels 32–36 are carried. The bearing surface 52 of the bearing plate 30 may be lubricated, Teflon coated or may be of a self-lubricating bronze material to decrease the friction between the steels and the bearing plate as the steels are slidably displaced relative to the bearing plate.

Figure 11:
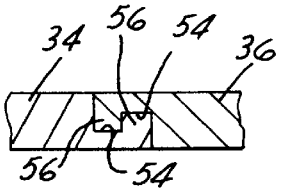
FIG. 11 is a fragmentary sectional view taken generally along line 11—11 of FIG. 8.
Figure 7:
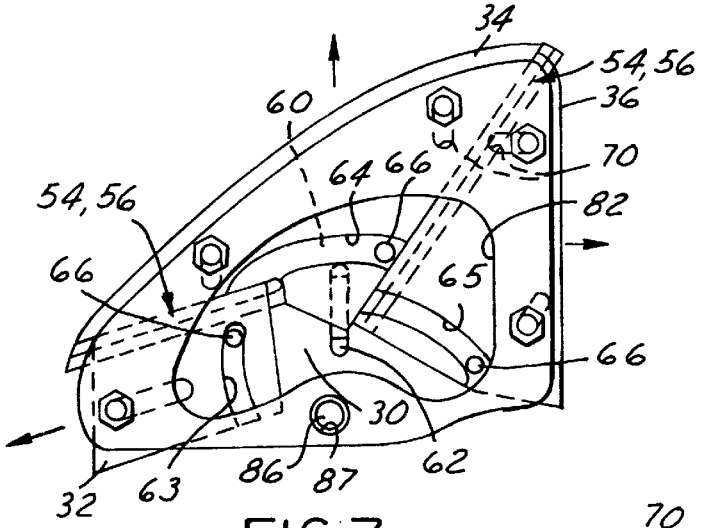
FIG. 7 is a sectional view taken along line 7—7 of FIG. 6.
Figure 8:
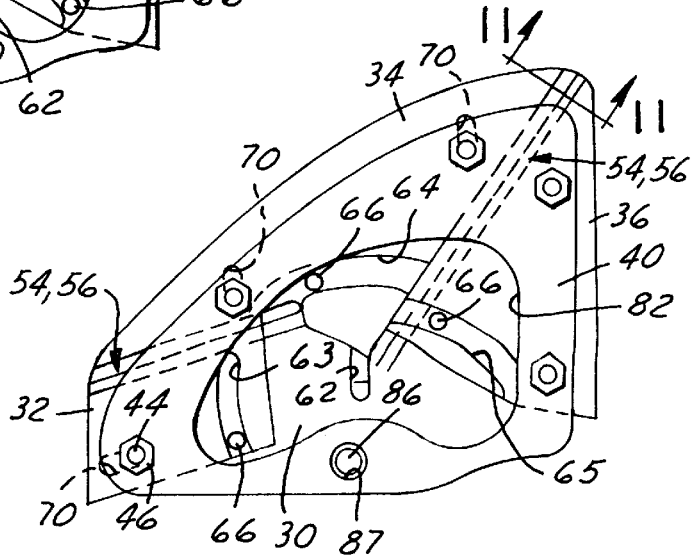
FIG. 8 is a sectional view per FIG. 7 illustrating the hemming steels in their extended position.

As best shown in FIGS. 5, 6, 9 and 10, the hemming steels 32–36 are preferably generally flat plates generally slidably received between the bearing plate 30 and the upper pull plate 40. As shown in FIGS. 7, 8 and 11, the three steels 32, 34, 36 have complimentary slidably engaging linear grooves and tongues along adjacent edges. Each groove 54 is formed along and spaced slightly inwardly of each edge adjacent another steel 32–36 along with a tongue 56 outboard of and parallel to the groove 54 to be received in a complimentary groove 54 of another steel 32–36. This tongue 56 and groove 54 arrangement, as best shown in FIG. 11, interlocks the steels 32–36 to prevent them from separating to provide a generally continuous hem forming surface without any voids or gaps between adjacent steels but permits the steels to be slidably displaced relative to one another in the direction of the grooves 54. At least one of the steels 32–36, and preferably the center steel 34 has a fixed key 60 (FIGS. 7 and 8) extending from its lower surface and slidably received in a complimentary slot 62 in the bearing plate 30 to guide the steel 34 for linear movement along the path defined by the slot 62. Each steel 32–36 has a separate cam track 63, 64, 65 formed therein and constructed to receive a separate roller follower 66 each attached to an actuator plate. The followers 66 bear on the steels 32–36 as the plate 68 is rotated to control the movement of the steels 32–36 between their extended and retracted positions. Each steel 32–36 also preferably has one or more clearance slots 70 therethrough constructed to receive the tie rods 44 with each slot 70 being large enough to prevent a tie rod 44 from interfering with the movement of a steel 32–36 between its extended and retracted positions. Preferably, as shown in FIGS. 5, 6, 9 and 10, the lower outer edge 72 of each steel 32–36 is generally beveled or inclined to facilitate initially bending or pre-hemming the flange 74 as the steel moves outward. As shown in FIG. 10, when the steels 32–36 are fully extended, the beveled edge 72 is beyond the flange 74 so that the generally flat lower face of the steels overlie the flange to complete the hem when the steels 32–36 are displaced (downward) towards the panels 18, 20.

As shown in FIGS. 7 and 8, the axis of the grooves 54 formed in each steel 32–36 and in which a complimentary tongue 56 of an adjacent steel is received are inclined at an acute included angle relative to the axis of the slot 62 in which the key is received. Thus, as the actuator plate 68 is rotated in one direction, the middle steel 34 is displaced along its fixed linear path of movement and the adjacent outer steels 32, 36 move both laterally with the middle steel and generally outwardly relative thereto along a path parallel to their interlocking tongues 56 and grooves 54 as all three steels are driven by the plate 68 and followers 66 received in their respective cam tracks 63, 64, 65. This provides a compound movement of the outer steels 32, 36 along the flat planar face 52 of the bearing plate 30 with the outer steels 32, 36 being displaced in the direction determined by the slot 62 and the direction or path defined by their respective tongue 56 and groove 54 connection with the middle steel 34. The relative rate of movement of the steels is controlled by the actuator plate 68, followers 66 and cam tracks 63, 64, 65. These parameters are selected and varied to provide the desired rate of advance of the steels to pre-hem the portion of the flange contacted by each steel and to move each steel to a fully extending position overlying the pre-hemmed flange before the final hemming movement thereof toward the panels.

Figure 12:
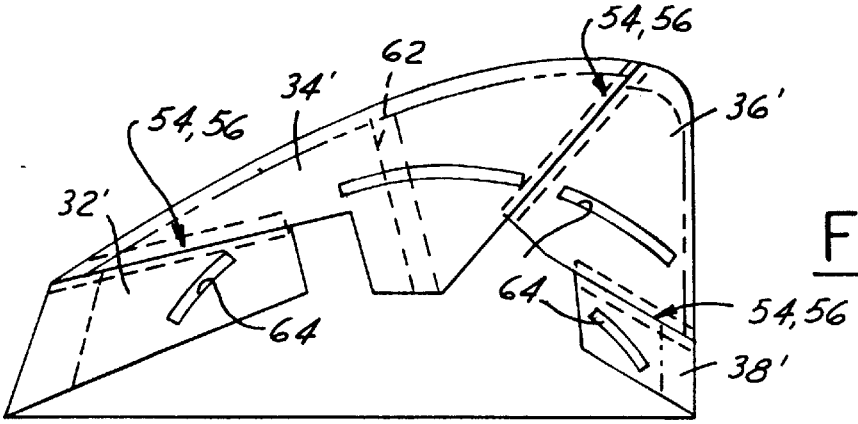
FIG. 12 is a diagrammatic view of a modified hemming apparatus having four hemming steels.

As shown in FIG. 12, more than three steels 32'–38' may be provided as desired to pre-hem and final hem substantially all of the desired portion of an interior opening. Regardless of the number of steels, each pair of adjacent steels are preferably slidably interconnected with the tongue 56 and groove 54 arrangement previously described to prevent the steels from separating in use.

The upper pull plate 40 preferably overlies at least a portion of each of the steels 32–36 and has a plurality of holes through which the tie rods 44 are received. A central opening 82 through the upper pull plate 40 provides access to each of the cam tracks 64 of the steels 32–36 so that the followers 66 of the actuator plate 68 can be received in the cam tracks 63, 64, 65.

Figure 3:
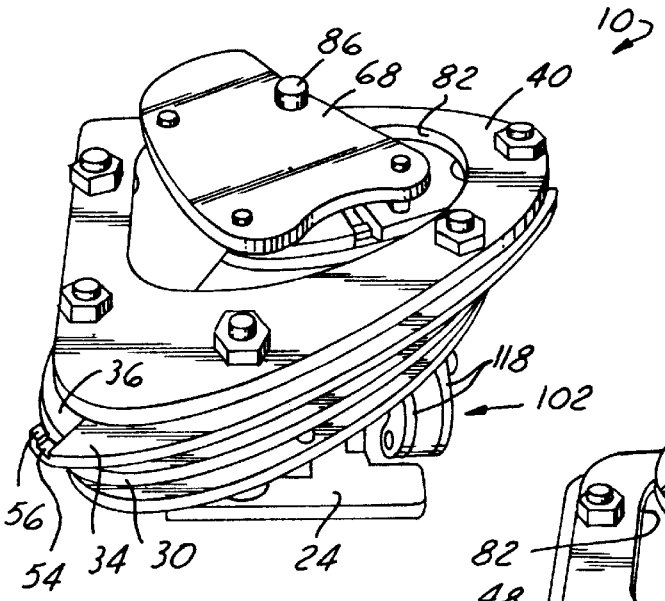
FIG. 3 is a perspective front view of the hemming apparatus illustrating the hemming steels in their retracted position.
Figure 4:
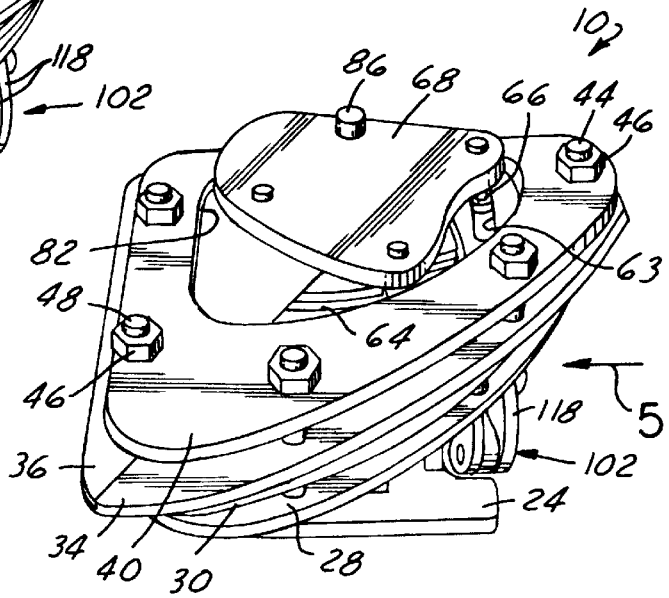
FIG. 4 is a perspective front view of the hemming apparatus illustrating the hemming steels in their extended position.

The actuator plate 68 preferably has one roller follower 66 received in the cam track 63, 64, 65 of each steel 32–36 and has an opening which receives one end of a shaft 86 fixed to the actuator plate 68. As best shown in FIGS. 9 and 10, the shaft 86 extends through and is journalled for rotation in openings 87, 88, 90 of the upper pull plate 40, the bearing plate 30 and the carrier plate 28, respectively, and has a lever arm 92 fixed to its opposite end. Preferably, the shaft 86 is also received in a journal block 94 fixed to the carrier plate 28 to further support and journal the shaft 86 for rotation. Movement of the lever arm 92 rotates the shaft 86 and the actuator plate 68 fixed thereto to displace the roller followers 66 in the cam tracks 63, 64, 65 of the steels 32–36. As the followers 66 are displaced in the cam tracks 63, 64, 65, they bear on and move the steels 32–36 between their extended and retracted positions. More specifically, when the actuator plate 68 is in a first position, as shown in FIG. 3, the steels 32–36 are in their retracted positions and movement of the lever arm 92 causing the actuator plate 68 to rotate counterclockwise (as viewed in FIGS. 3 and 4) to its second position, as shown in FIG. 4, moves the steels 32–36 to their extended positions. To retract the steels 32–36, the lever arm 92 is moved back to its original position which rotates the actuator plate 68 clockwise (as viewed in FIGS. 3 and 4) to return it to its first position. Preferably, the lever arm 92 is displaced by an actuating rod of a servo motor, ball screw drive, hydraulic cylinder or some such other power device (not shown).

As shown in FIG. 6, the lower pull plate 38 has an arcuate recessed portion 104 (FIG. 6) and side portions 106 extending around opposite sides of the supports 26 of the frame 24 to provide clearance for them. The lower pull plate 38 has a plurality of openings 100 through which the tie rods 44 are received. The pull plate 38 is connected to and supported on two or more sets of links 102 which are manipulated to cause the steels 32–36 to be raised and lowered relative to the panel 14.

The sets of links 102 are actuated by a second lever arm 108 which has a free end 110 and at its other end fixed to a shaft 112 journaled for rotation in bearings carried by the supports 26 of the frame 24 and having a pair of arms 116 fixed to its ends for rotation in unison therewith. Each set of links, 102 has two links 118 pivotally connected at one end by a pivot pin 120 to the other end of one arm 116 and at the other end pivotally connected to the lower plate 38 by a pivot pin 122 received in a carrier block 24 fixed to the lower plate 38. Preferably, two or more link sets 102 are provided with each set 102 disposed on opposite ends of the shaft 112 to act on generally opposed sides of the lower pull plate 38.

Figure 5:
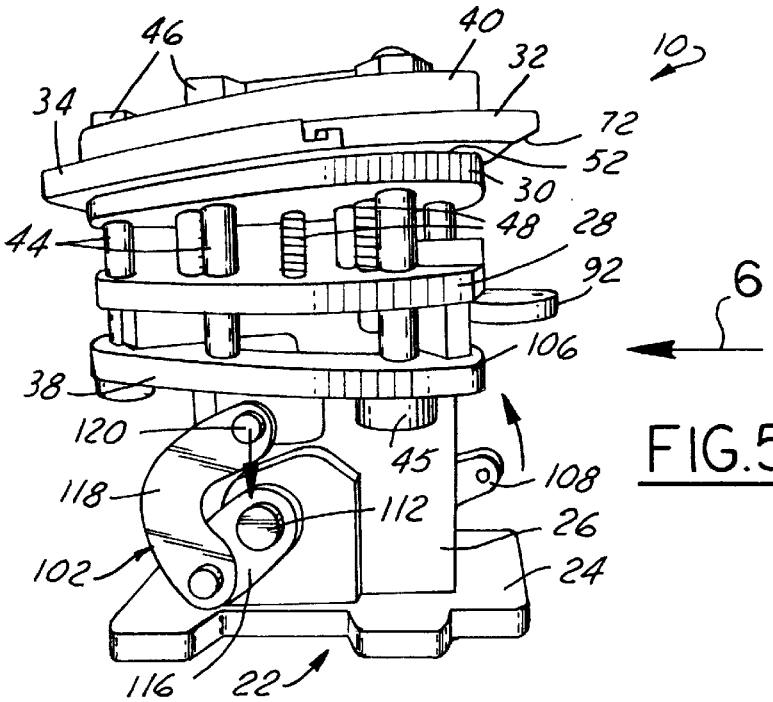
FIG. 5 is a perspective side view of the hemming apparatus.

Movement of the free end of the second lever arm 108 from a first position to a second position rotates the arms 116 counterclockwise as viewed in FIG. 5 and moves the lower pull plate 38 downwardly towards the base 24. Through the tie rods 44 this moves the upper pull plate 40, the steels 32–36 and the bearing plate 30 downward toward the carrier plate 28 against the bias of the springs 48. Rotation of the lever arm 108 from its second position to its first position raises the lower pull plate 38 so that the force produced by of the springs 48 will return the bearing plate 30, the steels 32–36 and the upper pull plate 40 to their original raised positions.

Operation

In use, as best shown in FIGS. 1 and 9, the apparatus 10 is disposed on or in a fixture 16 and is constructed to be received within an interior opening 12 of the door panels 18, 20 carried and located by the fixture 16. To form the flange about at least a portion of the interior opening 12 of the door panels 18, 20 a pre-hem is initially formed by rotating the lever arm 92 to rotate the actuator plate 68 and thereby move the roller followers 66 within the cam tracks 63, 64, 65 to slidably move the steels 32–36 generally radially outwardly to their extended positions (FIGS. 2 and 10). The generally beveled lower edges 72 of the steels 32–36 initially engage and partially bend the flange 74 of the outer panel 18 to an acute included angle preferably of about 60° to 30°. This pre-hems the flange 74 to the position shown in FIG. 9. The steels 32–36 are preferably further displaced towards their fully extended position wherein the flat lower surfaces 126 of the steels 32–36 overlie the tip or free end of the flange 74 of the panel 18 to be fully hemmed. Then, the second lever arm 108 is rotated from its first position to its second position and thereby rotates each of the arms 116 to move the links 118 and cause the lower pull plate 38 to be moved downwardly. This moves the upper pull plate 40 through the tie rods 44 to displace the upper pull plate 40, the steels 32–36 and the bearing plate 30 against the bias of the springs 48 downward to cause the steels 32–34 to engage and further bend and completely fold over the flange 74 of the outer panel 18 into engagement with the inner panel 20 to complete the hem as shown in FIG. 10. Preferably, the springs 48 having a maximum travel of about one-half inch to limit the displacement of the bearing plate 30, and thus, the steels 32–34.

After the full hem is completed, to retract the hemming steels 32–36 from the door panel 14, the second lever arm 108 is rotated from its second position back to its first position to rotate the arms 116 in the opposite direction and move the lower pull plate 38 through the links 118 upwardly. The bias of the springs 48 then returns the bearing plate 30, the steels 32–36 and the upper pull plate 40 to their raised position spaced from the panel 14. To retract the steels 32–36 radially inwardly, the lever arm 92 is rotated from its second position to its first position thereby rotating the actuator plate 68 and causing the roller followers 66 to move in the opposite direction in the cam tracks 63, 64, 65 to bear on the steels 32–36 and move them generally radially inwardly to their retracted positions within and spaced from the perimeter of the opening 12 of the hemmed door panel 14. With the hemming steels 32–36 received within the opening 12, the hemmed door panel 14 may be removed from the fixture 16 and another pair of panels 18, 20 disposed thereon so that a hem may be formed in them.

Second Embodiment

Figure 13:
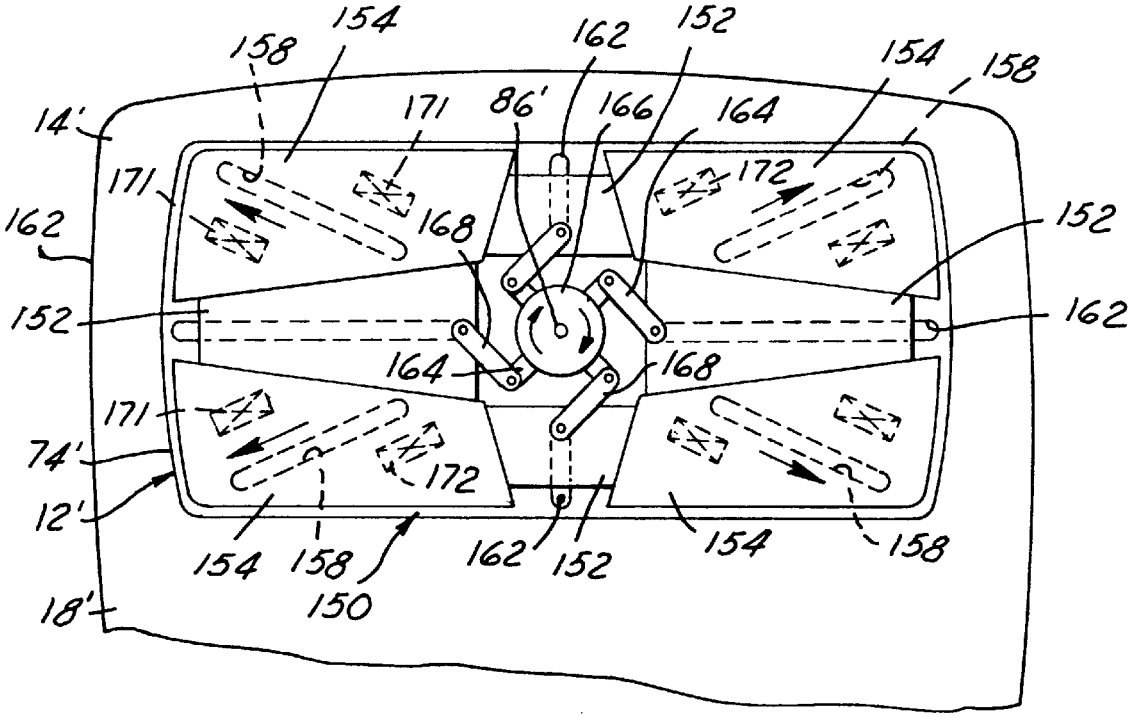
FIG. 13 is a plan view of a second embodiment of the hemming apparatus constructed to form a hem substantially completely about the entire perimeter of an interior opening of sheet metal panels.

FIG. 13 illustrates a second embodiment of a hemming apparatus 150 for forming a hem around substantially the entire perimeter of an inner opening such as a window opening 12' in the rear door assembly 14' of a stationary or sports utility vehicle. Hemming apparatus 150 has eight hemming steels with four generally wedge shaped steels 152 received between four corner steels 154. Each corner steel 154 preferably has a key 156 fixed thereon and slidably received in a complimentary groove 158 of the bearing plate 30' (as shown in phantom in FIG. 13) to guide each corner steel 154 for travel along the direction of its respective groove 158. Optionally, each of the wedge-shaped steels 152 may also have a key fixed thereon and received in a complimentary groove 162 formed in the bearing plate 30' to guide its movement. Each wedge-shaped steel 152 is coupled to an arm 164 fixed to an actuator disc 166 through a link 168 pivotally connected at one end to the steel 152 and at the other end to the arm 164. The actuator disc 166 is fixed to a shaft 86' journaled for rotation and connected at its other end to the lever arm 92. With the exception of the steels and the actuator, the hemming apparatus 150 is preferably the same as the apparatus 10 and, hence, it will not be described further.

As shown, rotation of the actuator disc 164 and arms 166 in the clockwise direction causes the links 168 to move generally counterclockwise about their pivots to move the wedge shaped steels 152 generally radially outwardly. This movement of the wedge shaped steels 152 drives each of the corner steels 154 generally radially outwardly along its path as defined by its key 156 and groove 158. The outward movement of each of the steels 152, 154 forms the pre-hem or the initial bend of the peripheral flange 74' of the window opening 12'. When fully extended, the steels 152, 154 substantially completely overlie the entire perimeter of the opening 12' through the panel 18', 20' such that when the second lever arm 108 (not shown in FIG. 13) is moved from its first position to its second position to move the steels 152, 154 downward toward the panels, a complete hem is formed about substantially the entire perimeter of the opening 12'. Typically, the flange 74' will have a notch or cutout in each corner of the window opening 12' to facilitate forming the hem and thus may be considered to have four flange segments each extending between a pair of adjacent corners.

To retract the steels 152, 154, the second lever arm 108 is returned to its first position to move the steels 152, 154 away from the fully hemmed panel 14' and then the crank arms 164 and disc 166 are rotated in the counterclockwise direction to retract the wedge shaped steels 152 generally radially inwardly until they are received within and spaced from the perimeter of the opening 12'. Preferably, each of the corner steels 154 have one or more springs 171 received in overlapping recesses 172 formed in the bearing plate 30 and the corner steels 154 to move the corner steels 154 generally radially inwardly along their fixed path of movement as the wedge shaped steels 152 are retracted. With each of the steels 152, 154 received within the window opening 12', the fully hemmed panel 14' can be removed from the fixture and a subsequent pair of outer and inner panels 18', 20' placed thereon to form a hem about the window opening 12' of these panels.

Although shown with crank arms 164 and associated links 168, the actuator disc 166 may also be of the cam type as described in the apparatus 10 with a cam track formed in each of the wedge shaped steels 152 and a follower received in each cam track so that upon rotation of the actuator plates the followers move within the cam tracks to displace the wedge shaped steels 152 and thereby control the displacement of the corner steels 154. In either form, each wedge shaped steel 152 is preferably interconnected with each adjacent corner steel 154 through the tongue 56 and groove 54 structure described in the preferred embodiment. Thus, each of the steels 152, 154 are interconnected and remain in contact throughout their movement to provide a substantially continuous forming surface to provide a substantially continuous hem about the perimeter of the window.

Third Embodiment

Figure 14:
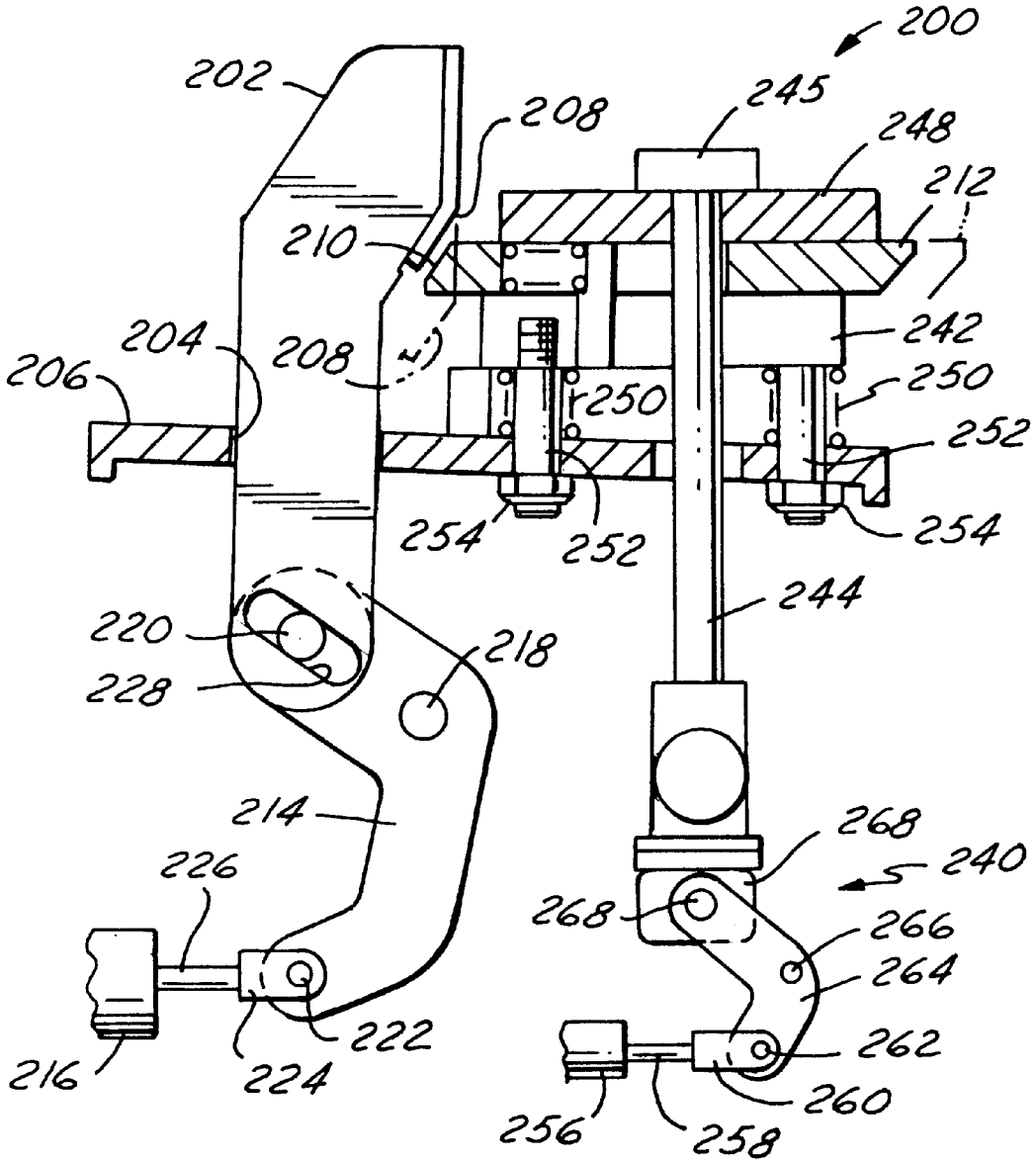
FIG. 14 is a side view of a third embodiment of the hemming apparatus.

As shown in FIG. 14, a third embodiment hemming apparatus 200 has an actuator 202 for each hemming steel 212 slidably received through an opening 204 in a base 206 and having an inclined cam face 208 constructed to engage a complimentary inclined follower face 210 of the hemming steel 212 to displace the hemming steel 212 from its retracted to its extended position as the actuator 202 is vertically displaced downward and its inclined face 208 bears on the hemming steel 212. As shown, the actuator 202 is driven through a bellcrank 214 by a hydraulic cylinder 216 or servomotor or the like. As shown, the bellcrank is journaled for rotation about a fixed pivot 218 and pivotally connected at one end to the actuator 202 by a pin 220 and pivotally connected at the other end by a pin 222 and trunnion 224 connected to an actuator rod 226 of the cylinder 216. The pivot pin 220 is received in an elongate slot 228 in the actuator 202 to provide a linear vertical movement of the actuator 202 relative to the base 206.

The steels are moved vertically by an actuator mechanism 240 which has an elongate pull rod 244 with an enlarged head 245. The rod 244 extends through the base 206, a bearing plate 242, the hemming steels 212 and a pull plate 248. The bearing plate 242 is spaced and yieldably urged away from the base 206 by one or more springs 250 each received on rods 252 threaded into the bearing plate 226 at one end, slidably received through the holes in base 206 and having a retainer nut 254 on its other end which also facilitates adjusting the distance between the bearing plate 242 and the base 206 and thus, the height of the hemming steels 212. The rod 244 is driven by a cylinder 256 with an actuator rod 258 pivotally connected by a trunnion 260 and pin 262 to a bellcrank 264 journaled for rotation about a fixed pivot 266 and pivotally connected to the pull rod by a trunnion 268 and pivot pin 270. Movement of the cylinder actuating rod 258 rotates the bellcrank about its pivot 266 to cause generally linear, vertical movement of the pull rod 244.

To form the pre-hem, the cylinder actuating rod 226 is extended to rotate the bellcrank 214 to move the actuator 202 downwardly so that its face 208 bears on the face 210 of the steel 212 to move the steel 212 to its extended position (shown in phantom). To complete the final hem, the cylinder actuating rod 258 is extended to rotate the bellcrank 264 and move the pull rod 244 downward to displace the hemming steels 212 downward toward the sheet metal panel 18, 20 as generally described in the other embodiments of the hemming apparatus.

In either embodiment of the hemming apparatus 10, 150, 200, the apparatus forms a substantially complete hem about at least a portion of the perimeter of an interior opening 12, 12' of a panel by initially moving the steels 32–36, 152–154, 212 generally radially outwardly to pre-hem the flange 74 and then subsequently displacing the steels towards the sheet metal panel 14 to complete the hem. Thus, a complete hem is formed about substantially the entire desired portion of the interior opening of the panel by a single apparatus 10, 150, 200 and at a single forming station.

What is claimed is:

1. An apparatus for forming a substantially continuous hem along at least a portion of a perimeter of an interior opening in a pair of panels comprising;

a frame;

at least two hemming steels slidably carried by the frame for movement along a first plane between retracted and extended positions and towards and away from the panel between first and second positions, the steels remain in contact with one another substantially throughout their movement;

a first actuator operably associated with the steels and constructed to reciprocate between first and second positions to move the steels between their retracted and extended positions; and a second actuator operably associated with the steels and constructed to reciprocate between first and second positions to move the steels towards and away from the panels whereby, upon movement of the steels from their retracted to their extended positions the hem is partially formed and upon movement of the steels towards the panel, the hem is completed.

2. The apparatus of claim 1 wherein the steels, when in their retracted positions, are received within and spaced from the perimeter of the opening in the panels, and when in their extended positions, are disposed substantially completely overlying the portion of the perimeter to be hemmed.

3. The apparatus of claim 1 wherein the steels, when in their first positions, are above the surface of the panel onto which the hem is to be formed, and when moved towards their second positions, are moved downward towards the panel to complete the hem.

4. The apparatus of claim 1 wherein the first actuator is an actuator plate having at least one follower for each steel each steel has a cam track formed therein to receive a follower such that movement of the actuator plate causes movement of the followers in their respective cam tracks to drive the steels between their retracted and extended positions.

5. The apparatus of claim 4 wherein the actuator plate is rotated between its first and second positions in a plane generally parallel to the first plane.

6. The apparatus of claim 1 wherein the first actuator is a member having a face inclined relative to the first plane and constructed to engage at least one of the steels to move the steels from their retracted to their extended positions as the member moves from a first position to a second position.

7. The apparatus of claim 6 wherein at least one of the steels is yieldably biased towards its retracted position so that when no longer displaced by the first actuator, that steel returns to its retracted position.

8. The apparatus of claim 7 wherein the yieldably biased steel is interconnected to each of the other steels such that when the yieldably biased steel is in its retracted position, the other steels are also in their retracted positions.

9. The apparatus of claim 6 wherein each of the steels are yieldably biased toward their retracted positions.

10. The apparatus of claim 1 wherein each steel is mechanically interlocked to each adjacent steel to prevent them from separating at least throughout their movement along the first plane.

11. The apparatus of claim 10 wherein each steel has a groove generally parallel to and spaced from each edge adjacent another steel and a tongue portion constructed to be received within a groove of each adjacent steel such that the steels are interlocked and slidably displaceable relative to each other.

12. The apparatus of claim 11 wherein one steel has a fixed direction of movement in the first plane and the adjacent edges of each steel are inclined relative to the fixed direction of movement in the first plane of said one steel so that movement of said one steel towards its extended position causes movement of each of the other steels towards their extended positions.

13. The apparatus of claim 12 which also comprises a key carried by the frame and received in a slot of the one steel having a fixed direction of movement to guide said one steel as it reciprocates between its retracted and extended positions.

14. The apparatus of claim 13 wherein movement of said one steel in the direction of its groove causes movement of each of the other steels in the same direction while the first actuator also slidably displaces the other steels relative to said one steel so that the steels also move generally radially outwardly and, in combination, substantially completely overlie a significant portion of the perimeter of the opening in the panel when in their extended positions.

15. The apparatus of claim 1 which also comprises a plate operably coupled to the second actuator and disposed adjacent to each of the steels, the plate transfers the force of the second actuator to the steels to displace them.

16. The apparatus of claim 1 which also comprises a bearing plate carried by the frame and having a generally flat upper face extending generally parallel to the first plane and on which the steels are slidably received.

17. The apparatus of claim 1 wherein at least two steels are provided, the first actuator is coupled to every other steel, and the steels not coupled to the first actuator are yieldably biased towards their retracted positions, the steels are constructed and arranged such that movement of the first actuator in a first direction directly moves all of the steels coupled to the first actuator from their retracted to their extended positions whereupon the steels coupled to the first actuator bear on and displace the other steels from their retracted to their extended positions and movement of the first actuator in a direction opposite the first direction moves the steels coupled to the first actuator back to their retracted position such that the yieldably biased steels not coupled to the first actuator return to their retracted positions.

18. The apparatus of claim 17 wherein every other steel is restrained to move along a fixed, straight path between its retracted and extended positions.

19. The apparatus of claim 18 wherein each steel coupled to the first actuator is restrained to move along a fixed, straight path between its retracted and extended positions.

20. The apparatus of claim 18 wherein each steel not coupled to the first actuator is restrained to move along a fixed, straight path between its retracted and extended positions.

21. The apparatus of claim 18 wherein each steel restrained to move along a fixed, straight path between its retracted and extended positions has a slot formed therein constructed to receive a key carried by the frame to guide the steel as it moves.

22. The apparatus of claim 17 wherein a hem is formed substantially completely about the perimeter of the opening in the panel.

23. The apparatus of claim 17 wherein each steel coupled to the first actuator is coupled through a first link and a second link, the first link is connected at one end to the first actuator and is rotatably connected at its other end to one end of the second link which is rotatably coupled at its other end to the steel.

24. The apparatus of claim 17 wherein each steel coupled to the first actuator has a groove formed therein and a follower connected to the first actuator is received in each groove such that movement of the first actuator moves the followers in their respective grooves and the followers displace the steels with the grooves to their extended positions.

25. The apparatus of claim 22 wherein eight steels are provided.

26. The apparatus of claim 22 wherein four steels are provided.

27. The apparatus of claim 1 wherein a hem is formed spanning an arc of at least 75°.

28. The apparatus of claim 27 wherein a hem is formed spanning an arc of at least 150°.

* * * * *

UNITED STATES PATENT AND TRADEMARK OFFICE

CERTIFICATE OF CORRECTION

PATENT NO : 5,979,208

DATED : November 9, 1999

INVENTOR(S) : William R. Hartley

It is certified that error appears in the above-identified patent and that said Letters Patent are hereby corrected as shown below:

Col 9, Line 27, after "steel" insert a comma -- , --.

Signed and Sealed this

Third Day of April, 2001

*Attest:*

Nicholas P. Godici

NICHOLAS P. GODICI

*Attesting Officer*

*Acting Director of the United States Patent and Trademark Office*